US012251037B2

(12) United States Patent
Novacek

(10) Patent No.: US 12,251,037 B2
(45) Date of Patent: Mar. 18, 2025

(54) EQUIPMENT PROVIDING GROUND COVER AND PROTECTION FROM DUST AND DEBRIS

(71) Applicant: Todd Novacek, Dana Point, CA (US)

(72) Inventor: Todd Novacek, Dana Point, CA (US)

( * ) Notice: Subject to any disclaimer, the term of this patent is extended or adjusted under 35 U.S.C. 154(b) by 314 days.

(21) Appl. No.: 17/533,813

(22) Filed: Nov. 23, 2021

(65) Prior Publication Data

US 2022/0151407 A1 May 19, 2022

Related U.S. Application Data

(63) Continuation-in-part of application No. 16/505,409, filed on Jul. 8, 2019, now Pat. No. 11,178,987.

(60) Provisional application No. 62/695,137, filed on Jul. 8, 2018.

(51) Int. Cl.

| | |
|---|---|
| ***A47G 9/06*** | (2006.01) |
| ***A47C 17/64*** | (2006.01) |
| ***E04H 15/00*** | (2006.01) |
| ***E04H 15/56*** | (2006.01) |

(52) U.S. Cl.

CPC ..... *A47G 9/062* (2013.01); *A47C 17/645* (2013.01); *E04H 15/005* (2013.01); *A47G 9/06* (2013.01); *E04H 15/56* (2013.01)

(58) Field of Classification Search

CPC ..... A47G 9/062; A47G 9/06; A47C 17/645; A47C 17/64; E04H 15/56; E04H 15/005

USPC ..... 5/417, 420

See application file for complete search history.

(56) References Cited

U.S. PATENT DOCUMENTS

| | | | | | |
|---|---|---|---|---|---|
| 2,898,609 | A * | 8/1959 | Storie | A45C 3/10 | 5/419 |
| 2,907,057 | A * | 10/1959 | Specht | E04H 15/62 | 5/417 |
| 3,226,737 | A * | 1/1966 | Rote | E04H 15/56 | 135/120.1 |
| 4,546,507 | A * | 10/1985 | Weinstein | A45C 3/10 | 5/419 |
| 4,682,447 | A * | 7/1987 | Osborn | A01G 20/43 | 383/4 |
| 4,703,528 | A * | 11/1987 | Rolle | A45C 3/10 | 5/502 |
| D311,473 | S * | 10/1990 | Vrabel | D6/603 | |
| 4,999,866 | A * | 3/1991 | Lindsey | A47G 9/062 | 5/427 |

(Continued)

*Primary Examiner* — Robert G Santos

(74) *Attorney, Agent, or Firm* — BECKMAN LAW P.C.; Christopher Beckman

(57) ABSTRACT

New forms of towels, mats, tarps and other ground-covering sheets, and other devices, systems and methods providing protection from sand, dust, debris, and fluids are provided. In some aspects of the invention, ground covering sheets with an inherent guard, partially around a periphery of the sheets, are provided. In several embodiments, specialized ground-covering sheets are provided with reinforced, specialized sections configured to receive and hold legs, ground stakes and/or other parts related to structures to be mounted in, on or about such ground-covering sheets. In some such embodiments, such reinforced, specialized sections include a matrix of expandable receiving brackets, through which the support legs, ground stakes and/or other parts can penetrate, and reach and obtain direct support from the ground below such ground-covering sheets.

20 Claims, 7 Drawing Sheets

© 2018 - 2022.
all rights reserved

(56) References Cited

U.S. PATENT DOCUMENTS 5,299,331 A * 4/1994 Badillo ..... E04H 15/62 5/922
5,473,785 A * 12/1995 Lager ..... A47D 9/005 5/655
5,564,232 A * 10/1996 Callaway ..... A01G 13/0293 D8/391
5,740,566 A * 4/1998 Stacy ..... A47G 9/062 224/156
5,758,373 A * 6/1998 Bloetjes ..... A47G 9/062 2/252
6,226,813 B1 * 5/2001 Wilburn ..... E04H 15/62 135/118
D591,947 S * 5/2009 Williams ..... A47G 9/062 D3/5
D593,744 S * 6/2009 Williams ..... A47G 9/062 D3/5
7,614,100 B1 * 11/2009 Barrington ..... A47G 9/062 5/413 R
8,122,538 B2 * 2/2012 McBrearty ..... A47G 9/062 297/229
8,327,476 B1 * 12/2012 Paratore ..... A47G 9/062 5/656
9,161,641 B2 * 10/2015 Wentland ..... A47G 27/0225
9,259,108 B2 * 2/2016 Snep ..... A47G 9/062
9,968,225 B2 * 5/2018 Andresen ..... B65D 85/70
10,463,178 B2 * 11/2019 Coffey ..... A47G 9/062
11,178,987 B2 * 11/2021 Novacek ..... A47G 9/062
11,510,511 B2 * 11/2022 Wright ..... A47G 9/062
D974,079 S * 1/2023 Allender ..... D6/603
2011/0047697 A1 * 3/2011 McBrearty ..... A47G 9/062 5/417
2013/0074259 A1 * 3/2013 Snep ..... A47G 9/062 5/420
2015/0113730 A1 * 4/2015 Wentland ..... A47G 9/062 5/417
2017/0055736 A1 * 3/2017 Coffey ..... A47G 9/062
2017/0196410 A1 * 7/2017 Andresen ..... B65D 85/70
2020/0008594 A1 * 1/2020 Novacek ..... E04H 15/005
2022/0151407 A1 * 5/2022 Novacek ..... E04H 15/005
2022/0240696 A1 * 8/2022 Wright ..... A47G 9/062

* cited by examiner

© 2018 - 2022,
all rights reserved

© 2018 - 2022,
all rights reserved

© 2018 - 2022,
all rights reserved

© 2018 - 2022,
all rights reserved

© 2018 - 2022,
all rights reserved

© 2018 - 2022,
all rights reserved

EQUIPMENT PROVIDING GROUND COVER AND PROTECTION FROM DUST AND DEBRIS

CROSS-REFERENCE TO RELATED APPLICATIONS

This application is a continuation-in-part of co-pending U.S. patent application Ser. No. 16/505,409, titled "Towels and Mats Enhancing Beach and Camping Activities," filed Jul. 8, 2019, now U.S. Pat. No. 11,178,987, which claims the benefit of U.S. Provisional Application No. 62/695,137, filed Jul. 8, 2018, titled "Towels and Mats Enhancing Beach Activities," the entire contents of each of which applications are herein incorporated by reference in their entirety.

© 2018-2022, Todd Novacek. The disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Unless otherwise stated, all trademarks disclosed in this patent document and associated application parts and other distinctive names, emblems, and designs associated with product or service descriptions, are subject to trademark rights. Specific notices also accompany the drawings incorporated in this application; the matter subject to this notice, however, is not limited to those drawings.

FIELD OF THE INVENTION

The present invention relates to the field of recreational devices, textiles and methods of their use. More specifically, some aspects of the present invention relate to beach towels and mats optimized for sand resistance.

BACKGROUND

Flat, flexible pieces of paper or fabric known as towels date at least to the 17$^{th}$ Century, in Bursa, Turkey. In the early towel industry of Bursa, basic cotton and linen towels, designed for absorbency, predominated. The fibers of cotton and linen fabrics wick water, sweat and other liquids from the skin, among other advantages. Over time, specialized, thicker towels, with even greater absorbency, were created for bathing. Commonly, a bath towel includes many surface-covering loops of material, which project outward and dramatically increase the effective surface area for drying a user's skin.

Individuals have also used towels at the beach for at least a century. As in the context of bathing, a thick towel, including surface-covering loops, is a regular feature of beach towels. However, because beachgoers also use towels to cover a section of sand or other ground materials, and sit or lie on them, most versions of the beach towel today include the surface-covering loops on one side only (the side facing the user's body). The ground-facing sides of such towels, by contrast, typically have the loops shorn off, reducing unnecessary weight. However, the stems of the fibers that formed the loops that were shorn off remain and provide some absorbency. Thus, both sides of such towels may, in some instances, be used for drying. Beach towels are also often wrapped around a user's body, as a skirt or other body wrap, and may be used as a cover when changing clothes at the beach.

There are several drawbacks to the use of towels at the beach, however. For one, sand tends to penetrate and gather within towels. When a user lies on a sandy towel, the sand then tends to adhere to his or her body, creating a mess that only grows worse when the user returns to a motor vehicle and/or home, shedding sand all around the person. Users tend to shake towels vigorously at the beach, in an effort to clean out the sand, with limited effect. The process of shaking also may shower neighboring people or objects with sand, creating other complications and conflicts, especially in busy beach settings, such as those found in some beach cities in Southern California.

In recent years, some devices and materials have been developed to reduce the accumulation of sand at the beach. For example, CGear Australia, Pty. Ltd., of Victoria, Australia, sells a sand-reducing beach mat, with a polyethylene mesh allowing sand to drop through the mat from the top side, to the ground.

It should be noted that some of the disclosures set forth as background, such as, but not limited to, the above language under the heading "Background," do not relate exclusively to prior art and the state of the art in the field(s) of the invention, and should not be construed as an admission with respect thereto.

SUMMARY OF THE INVENTION

New forms of towels, mats, tarps, textiles, devices, systems and methods are provided. In some aspects of the invention, such a ground-covering sheet includes a guard around a periphery of the sheet, preventing the influx of dust, sand, fluids, and debris. In some embodiments, specialized ground-covering sheets are provided with reinforced, specialized sections configured to receive and hold legs, ground stakes and/or other parts related to structures to be mounted in, on or about such ground-covering sheets. In some such embodiments, such reinforced, specialized sections include a material configured to be penetrated by such legs, ground stakes and/or other parts while supporting and/or receiving support, therefrom. In some such embodiments, such specialized sections include a matrix of expandable receiving brackets, through which the support legs, ground stakes and/or other parts can penetrate, and reach and obtain direct support from the ground below such ground-covering sheets.

In other aspects, such a guard comprises an internal inflatable skeleton, optimized to demark a home base and prevent small children from wandering from a play area on or about the home base. In still other aspects, the towel or mat is configured for packing and toting by folding and rolling techniques, and the towel or mat presents specialized packing, toting and other devices, such as a sealable pocket(s), reversible self-holding strap(s) and a shoulder strap(s), when so folded and rolled. In several embodiments, the profile and component material(s) of the towel or mat are specialized to prevent the influx and retention of sands and other loose ground particles.

These and other aspects of the invention will be made clearer below, in other parts of this application. This Summary, the Abstract, and other parts of the application, are for ease of understanding only, and no part of this application should be read to limit the scope of the invention, whether or not it references matter in any other part.

DETAILED DESCRIPTION OF THE INVENTION

Figure 1:
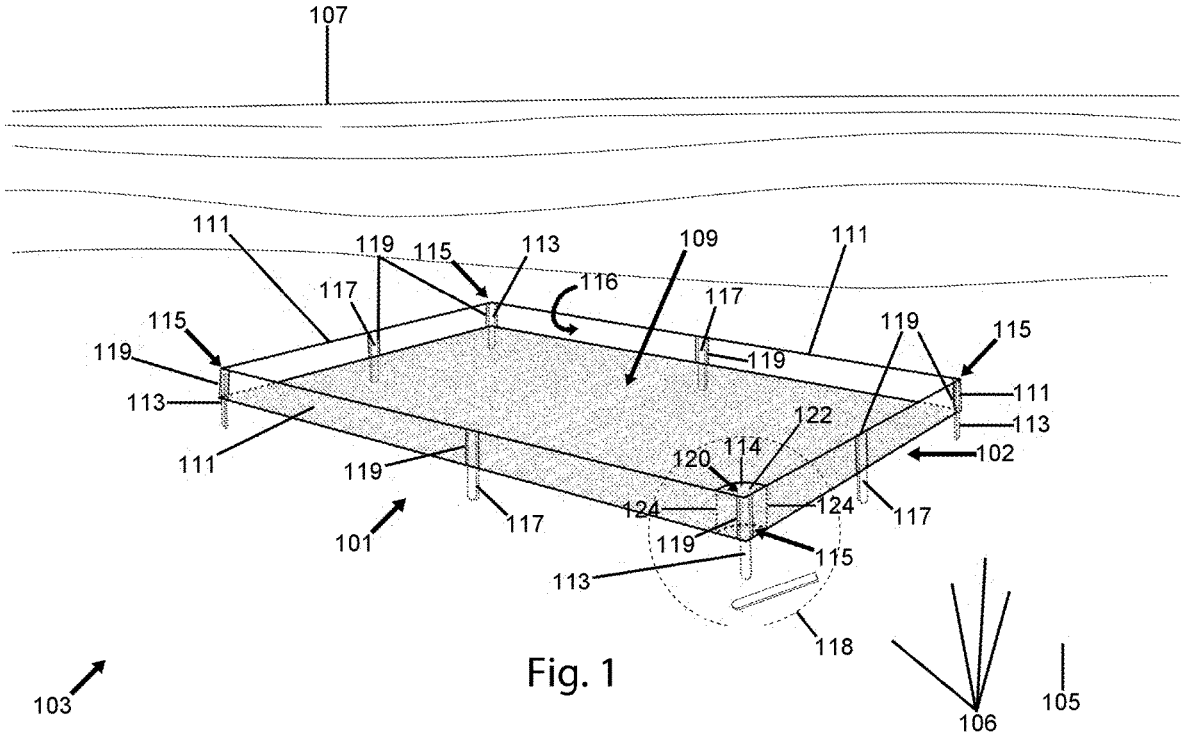
FIG. 1 is a perspective view of an example beach towel adapted for use in a beach setting, in accordance with some aspects of the present application.

FIG. 1 is a perspective view of an example beach towel 101, adapted for use in a beach setting 103, in accordance with some aspects of the present application. Beach setting 103 may include a beach 105, covered with sand or other loose ground particles, such as the examples shown as sand grains or other loose ground particles 106, and an abutting ocean 107. Beach towel 101 is shown placed on a personal recreation area 102 of a suitable size for a person, such as a user of towel 101, to lie down and move around the area several inches, or, in some embodiments, even several feet, while resting, rolling laterally or crawling. In some embodiments, configured for use by adults, area 102 may be, or may approximately be, a 30-inch-by-70-inch-area of the surface of beach 105, over and above sand or other loose ground particles, such as example sand grains or other loose ground particles 106. In other embodiments, personal recreation area 102 may be significantly larger, or smaller, than 30 inches by 70 inches. For example, in embodiments, some of which may be adapted for children's use, personal recreation area 102 may measure, or may approximately measure, 25 inches by 30 inches. In other embodiments, personal recreation area 102 may measure 32 inches by 64 inches. As another example, in embodiments adapted for multiple users, and/or for more activity by user(s), personal recreation area 102 may measure, or may approximately measure, 10 feet by 10 feet (100 square feet). In some other embodiments, personal recreation area 102 may measure somewhat larger or smaller than the dimensions discussed above and/or illustrated in the figures. In some embodiments, personal recreation area 102 may measure any dimensions between the dimensions set forth above. In accordance with aspects of the present invention, beach towel 101 is adapted to define and enhance a personal recreation area, such as exemplary personal recreation area 102, through various structural and methodological aspects of the present invention as set forth in greater detail below.

Example beach towel 101 is shown comprising a generally rectangular sheet of flexible cotton material. As used in the present application, a "sheet" is any generally flattened piece of material, such as a towel, mat, tarp, blanket, cloth or other textile. In some embodiments, example beach towel 101 may include any shape and material suitable for absorbing and/or wicking away moisture from a human body. For example, in some embodiments, example beach towel 101 may comprise cotton. As another example, in some embodiments, example beach towel 101 may comprise polyester. As another example, in some embodiments, example beach towel 101 may comprise blends of any suitable fabric component or material. In some embodiments, example beach towel 101 may comprise sub-structures of such components or materials for enhancing that absorption and wicking. For example, such sub-structures comprise those found in terry cloth, in some embodiments. As another example, such sub-structures comprise a nap in some other embodiments. As another example, such sub-structures comprise loops of material, in some embodiments. As another example, such sub-structures comprise projections of material, in some embodiments. In some embodiments, such sub-structures comprise any suitable material or structure suitable for use in beach towels. If present, at least some of such absorption and wicking textiles, textile materials and sub-structures preferably face a user's body (upwards, in the perspective of the figure), rather than the ground, during use of example beach towel 101. Thus, those textiles, textile materials and sub-structures may line the upper flat surface 109 of towel 101. In some embodiments, however, such materials and/or substructures also face away from a user's body (downwards, in the perspective of the figure.

It should be noted that the listing of possible structures, substructures, materials, textiles, devices, methods, steps and other aspects of the present invention, in particular configurations and arrangements, as set forth explicitly herein, is only a set of examples of the many possible different variations and combinations of aspects that are within the scope of the present invention, as will be readily apparent to those of ordinary skill in the art. For example, the description of one particular order, number or other arrangement of some, any aspects or embodiments of the present invention set forth herein is illustrative, not limiting, and all other possible orders, numbers, arrangements, combinations, etc., are also within the scope of the invention, as will be so readily apparent. Any aspect of the invention set forth herein may be included with any other aspect(s) in a particular embodiment, as well as any aspects known in the art, in any number, order, arrangement, or alternative configuration while still carrying out, and falling within, the scope of the invention.

To reduce the accumulation of sand and loose ground particles, such as sand grains or other loose ground particles 106, on upper flat surface 109 of example beach towel 101, example beach towel 101 may comprise a sand guard 111, erected about the outer edge of upper flat surface 109 of example beach towel 101, and attached and/or integral with it. In some embodiments, sand guard 111 may be erected about a periphery of upper flat surface 109 of example beach towel 101. In some embodiments, sand guard 111 may be erected about a perimeter of upper flat surface 109 of example beach towel 101.

Sand guard 111 may include any of the same textile compositions and sub-structures discussed above, in some embodiments. In some embodiments, sand guard 111 includes or another, flexible textile composition, than that set forth above for example beach towel 101 generally. In some embodiments, sand guard 111 is erected at or about a 90-degree angle (perpendicular to flat surface 109 and/or the surface of beach 105). In some such embodiments, sand guard 111 is erected and held in place with the aid of ground-penetrating stakes 113. In some such embodiments, ground-penetrating stakes 113 are located at spaced intervals within and/or about sand guard 111. In some embodiments, ground-penetrating stakes 113 comprise any suitable stiff or semi-rigid durable material for providing support to tents or other erected flexible or other material walls. In some such embodiments, ground-penetrating stakes 113 include a plastic and/or nylon. In some embodiments, ground-penetrating stakes 113 include a metal and/or alloy. In some embodiments of the invention, several ground-penetrating stakes 113 are provided. In some embodiments, at least one of ground-penetrating stakes 113 is provided at each corner 115 of beach towel 101 and sand guard 111. In some embodiments, at least one additional set of sand guard stakes 117, each of which sand guard stakes 117 may be equidistant from at least two of corners 115, and also at or about the outer perimeter or edge of upper flat surface 109 of beach towel 101 and sand guard 111, are also included. But other numbers, types, shapes and arrangements of such stakes 117 may be used, in various alternative embodiments, in addition to those explicitly set forth above while still carrying out aspects of the present invention, as will be readily apparent to those of ordinary skill in the art.

To aid in erecting sand guard 111, each stake (whether one of ground-penetrating stakes 113 or one of sand guard stakes 117, which may be identical in form, in some embodiments) may first be slipped into any of several corresponding stake-accepting pockets, such as the examples shown as stake-accepting pockets 119, of sand guard 111, at or about the same locations as pictured for stake-accepting pockets 119 about the perimeter of upper flat surface 109. On the inward-facing surface 116 of sand guard 111, and at any (or, in some embodiments, in some or in each) corner 115, an interior pocket(s), such as the example shown as interior pocket 114, may also be provided in various embodiments (although it may be excluded in other embodiments). In some embodiments, the interior pocket(s), such as interior pocket 114, comprise an open top 120, opening onto an interior storage volume 122, defined by pocket wall(s) 124. Some or all of pocket walls 124 are bonded or otherwise fastened together in some embodiments (e.g., by stitching, adhesive or welding) and, in some such embodiments, bonded or otherwise fastened to the inward-facing surface 116. In some such embodiments, some or all of pocket walls 124 are also bonded or otherwise fastened to surface 109, providing a storage volume 122. In some embodiments, storage volume 122 is substantially waterproof or water-resistant, reducing the infiltration of water into it. In some embodiments, storage volume 122 is sand-proof or sand-resistant, reducing the infiltration of sand into it.

In some embodiments of the invention involving methods, once towel 101 has been installed on a personal recreation area 102, a user may fill a storage volume 122, of each and every interior pocket 114, with an object(s) or material, such as sand or ground particles 106, or a water or other bottle or weight, to anchor towel 101 in place. One or more pocket(s), such as interior pocket 114, and this anchoring aspect may be practiced with or without the use of the exact embodiment pictured for pockets (such as interior pocket 114), without stakes (such as ground-penetrating stakes 113 or sand guard stakes 117), in some embodiments. In some embodiments, this anchoring aspect may be practiced without some of the pockets such as interior pocket 114, or without such stakes, which may not even be present in some such embodiments, and may be omitted or partially omitted, in some such embodiments. Conversely, in some embodiments, pockets such as interior pocket 114 may be present in each and every corner 115 of beach towel 101, with or without any or all other aspects of corners of towels, mats and tarps set forth in this application, or, in some other embodiments, in only some corners, with or without some such stakes and stake-accepting pockets 119, in any possible combination thereof. It should also be noted that, while pockets such as interior pocket 114 are shown within FIG. 1, as interior pockets bound to the inward-facing surface 116 of sand guard 111, pockets such as interior pocket 114, and the methods corresponding with them, may be so present in, and attached to, any other embodiment of the invention set forth in this application. For example, interior pockets such as interior pocket 114 may be attached to an interior surface of any of the sand guards set forth in this application, and/or to any surfaces of other towels, tarps or mats set forth in this application, at any location (such as, but not limited to, the corners of such towels and mats) wherein they may be filled with water, sand or any other material for aiding in anchoring towels, mats, tarps or tents. In different embodiments, a pocket in the form of a bag may be attached to, and provided at, each corner 115, to aid in accepting and conjoining towel 101 with tent legs. Some such embodiments may omit any other aspect of towel 101 discussed above, including sand guard 111, in some embodiments. Some such embodiments will be discussed in greater detail below.

Figure 2:
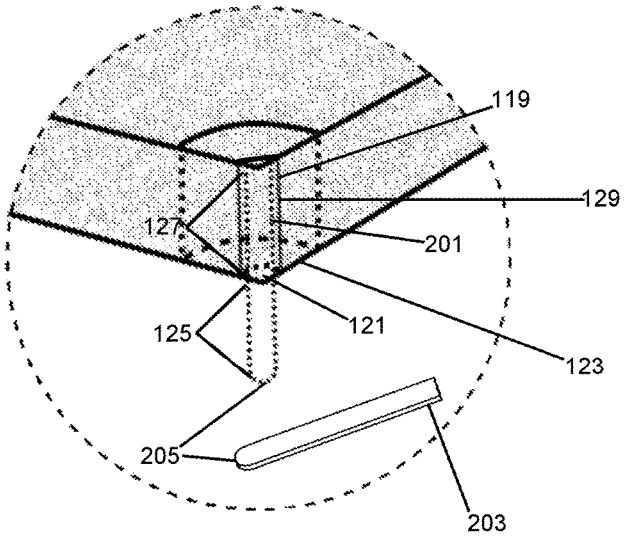
FIG. 2 is an enlargement for magnification purposes of a partial view of FIG. 1, showing details of an exemplary installed stake, and loose stake, for anchoring and erecting a sand guard of the beach towel in accordance with some aspects of the present application.

Details related to some of the aspects of the invention discussed above are shown in greater detail in FIG. 2, which is an enlargement for magnification purposes of partial view 118 of FIG. 1, showing details of an exemplary installed stake 201 and loose stake 203, each of which may comprise the same form and materials as any or all of ground-penetrating stakes 113 or sand guard stakes 117. Each of stake-accepting pockets 119 has a downward-facing opening 121, which may be slightly larger in diameter than each such stake. The overall shape of each of stake-accepting pockets 119 also may be slightly larger in diameter, but complimentary in shape to, each such stake, with tolerances that prevent the accidental escape of those stakes from stake-accepting pockets 119, with friction. However, stake-accepting pockets 119 are preferably each substantially shorter in length than those stakes. Once one of such stakes is placed in each of stake-accepting pockets 119, preferably half or slightly greater than half of each such stake is installed within each of stake-accepting pockets 119, while the other approximately half or less than half of each of the stakes remains exposed, extending below the bottom edge 123 of sand guard 111. As a result, once such stakes have been installed within pockets 119, a user may next pierce the sand grains or other loose ground particles of recreation area 102 with those exposed ends of those stakes, installing sand guard 111 into the ground, and erecting sand guard 111, as pictured. In some embodiments, when installed within stake-accepting pockets 119, approximately one-half of the length, or some other substantial proportion, of each of those stakes (such as, for example, the lower length and section 125 shown) is buried, having been inserted into sand grains or other loose ground particles of beach 105, while the other approximately one-half, or some other substantial proportion, of the length of each of those stakes 113 (such as, for example, upper length and section 127) is held within one of stake-accepting pockets 119—namely, example stake-accepting pocket 129—of sand guard 111. Thus, in some embodiments, when fully installed in both sand guard 111 and beach 105, each stake is invisible to a user, but anchors towel 101 and sand guard 111 in place, and erects sand guard 111 to prevent the influx of sand grains or other loose ground particles within personal recreation area 102.

To better visualize an example form of stakes that may be used as ground-penetrating stakes 113 or sand guard stakes 117, an example loose, uninstalled stake 203 is provided, pictured lying on the beach (details of which have been omitted in this figure, to prevent obscuring aspects of the invention). A number of such stakes may be included in various embodiments of the invention, allowing for the replacement of broken or misplaced stakes. The example form shown as example loose, uninstalled stake 203 may generally be in the shape of a traditional tongue depressor used by medical personnel. More specifically, at least one end, such as example end 205, is preferably rounded and/or blunt-edged, allowing for the streamlined penetration of loose ground particles, while not posing a sharp, piercing or other skin-cutting danger to users, which may be caused by a more traditional, sharper form factor for anchoring stakes. However, in some embodiments, a more traditional, pointed form factor for such stakes may be used, instead or in addition to the format shown as loose stake 203. In any event, installed stake 201, and example loose, uninstalled stake 203, each may comprise any suitable material for anchoring stakes known in the art, such as those materials discussed above, and may be of the same form and materials as any or all of stakes discussed above, for ground-penetrating stakes 113 and sand guard stakes 117.

Figure 3:
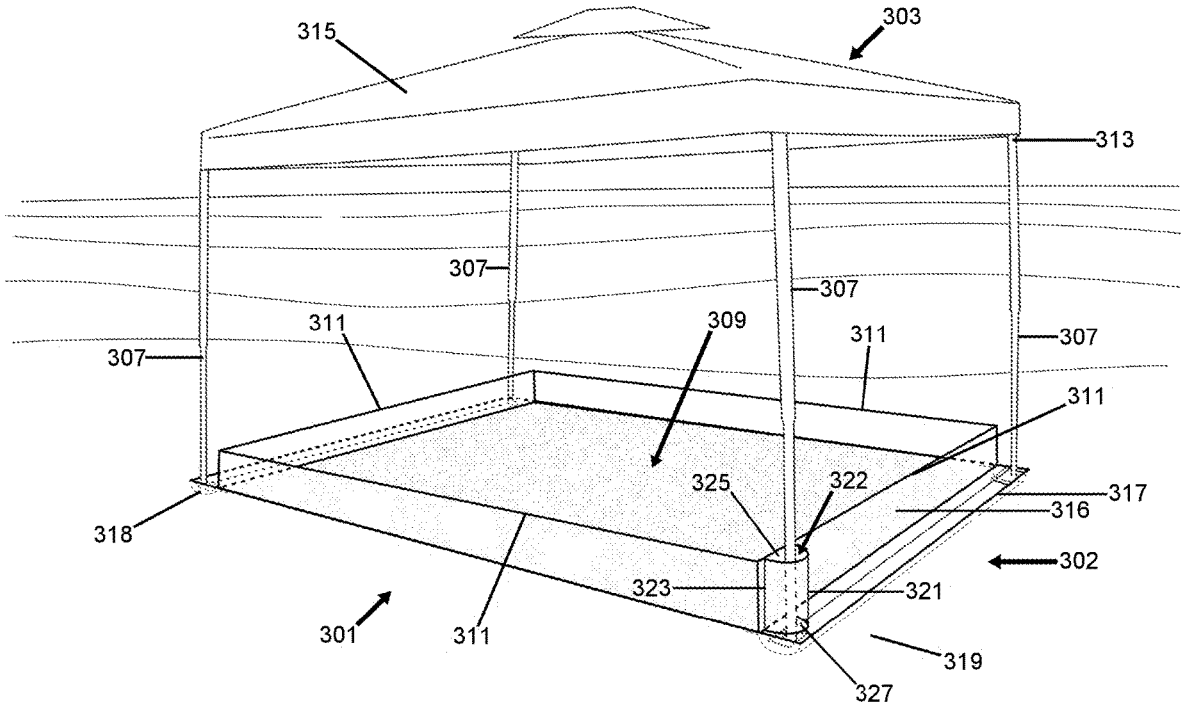
FIG. 3 is a perspective view of an example larger format beach towel or mat, adapted for use with a pop-up canopy tent, in accordance with some aspects of the present application.

FIG. 3 is a perspective view of an example embodiment of a larger format beach towel or mat 301, adapted for use with a pop-up canopy tent 303, in accordance with aspects of the present application. As with the example beach towel 101 set forth above (which, as with larger format beach towel or mat 301, may be a mat, such as a tarp), example towel or mat 301 is shown placed on and adapted to define and enhance, a personal recreation area (now personal recreation area 302). Also as set forth above, in reference to exemplary towel 101, example larger format beach towel or mat 301 preferably lies over and above the sand grains or other loose ground particles 106 of personal recreation area 302, and is adapted to prevent the influx of sand and loose ground particles, such as 106, onto an upper flat surface, now upper flat surface 309, of larger format beach towel or mat 301, which may comprise the same or similar types of textiles and other materials and substructures as set forth above for beach towel 101. Accordingly, larger format beach towel or mat 301 may comprise a sand guard 311, which may be the same or similar in nature to that discussed in reference to sand guard 111, above. However, as with sand guard 111, any and all other forms of sand guards set forth in the present application, or known in the art, may also, or alternatively, be used, in conjunction with the other aspects of larger format beach towel or mat 301, set forth herein, in accordance with certain embodiments of the present invention.

In some embodiments, larger format beach towel or mat 301 comprises a larger and more robust form factor than that set forth above for beach towel 101. For instance, rather than being suitable only for a single user, or two users, who may lie on larger format beach towel or mat 301, a plurality, or larger plurality, of users may comfortably lie, sit or engage in other recreational activities on a larger personal recreational area 302. In some embodiments, personal recreational area 302 and upper flat surface 309 may be at least twice as large as personal recreational area 102. In still other embodiments, personal recreational area 302 and upper flat surface 309 may be, or may approximately be, a 10-foot-by-10-foot area. In some embodiments, personal recreational area 302 and upper flat surface 309 may be, or may approximately be, any other area typically coinciding or nearly coinciding with popular pop-up canopy tents, such as the 10-foot-by-10-foot portable shelters available from E-Z Up, Inc., of California.

In some embodiments, larger format beach towel or mat 301 may comprise additional substructures, configured to accept and anchor the legs 307 of example pop-up canopy tent 303's frame 313, which legs 307, in turn, anchor and support example canopy 315. More specifically, a foot-accepting trench device 317 may be included in towel or mat 301, adjacent to and abutting at least one outer side 316 of sand guard 311. As with sand guard 111 and sand guard 311, foot-accepting trench device 317 preferably is attached to and/or integral with the remainder of larger format beach towel or mat 301. In some embodiments, one trench, such as that shown as foot-accepting trench device 317, is included. In other embodiments, two or more trench devices, such as example foot-accepting trench devices 317 along with example foot-accepting trench device 318, are included, each of which is configured to accept and anchor one or more, or all of, legs 307, collocating and anchoring tent 303 with personal recreation area 302, and shading and sheltering it with a protective umbrella or canopy 315 attached to legs 307.

Foot-accepting trench device 317 and foot-accepting trench device 318 may include a number of additional sub-structures and aspects, in some embodiments, which will be discussed in greater detail below, in reference to FIG. 4.

In some embodiments, an exterior pocket(s) or sheath(s), such as example pocket or sheath 321, may also be provided. In some embodiments, exterior pocket or sheath 321 has an open top 322, and at least one wall(s) 323, encompassing a passageway and leg-holding volume 325. In addition, as with interior pocket 114, discussed above, the at least one wall(s) 323 of pocket or sheath 321 may be bonded or otherwise fastened together (e.g., by stitching, adhesive or welding), to a surface of sand guard 311. In some embodiments, such a surface is an outer surface 316 of sand guard 311. In some embodiments, the at least one wall(s) 323 of pocket or sheath 321 may also be bonded or otherwise fastened to upper flat surface 309. As also shown in the figure, in some embodiments, some or all pockets or sheaths set forth in the current application may have an open bottom 327, allowing supports (such as legs 307) or other materials to pass completely through them, and onto the ground or other intermediate structures, as discussed further herein.

Figure 4:
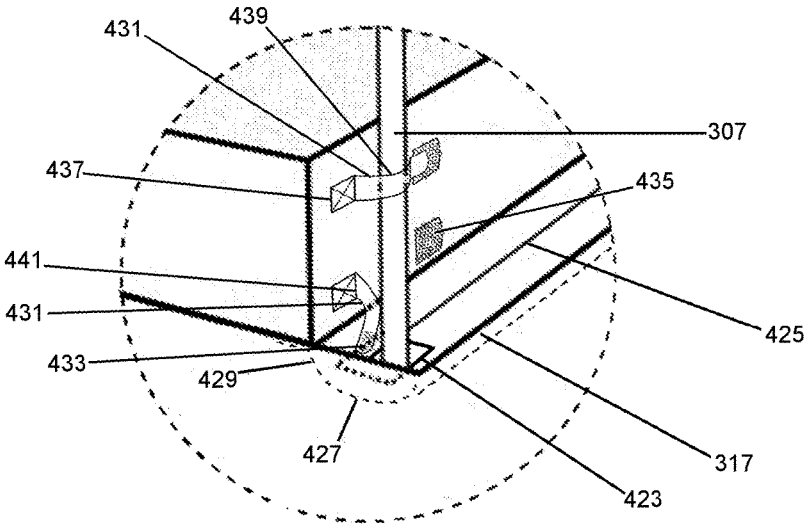
FIG. 4 is an enlargement for magnification purposes of aspects of a partial view of FIG. 3, illustrating some additional embodiments of the invention, showing, among other things, details of an example trench device for anchoring and holding the feet of a pop-up canopy tent, collocating it with a personal recreation area, in accordance with some aspects of the present application.

FIG. 4 is an enlargement for magnification purposes of aspects of partial view 319 of FIG. 3, showing details of example foot-accepting trench device 317. As better shown by magnification, an example leg 307 includes a substantially flat foot 423 with a wider profile than the remainder of leg 307. Such flattened, widened feet for tent legs may provide a wider, more stable platform for tents to rest on the ground, generally. However, because they extend to some degree laterally, they are also held better in place by an intrinsic overhang 425 of trench device 317.

As also better shown by magnification, in some embodiments, trench device 317 comprises a complementarily shaped bottom 427. In some such embodiments, complementarily shaped bottom 427 includes sloped sides, such as the example shown as sloped side 429, that encourage the placement of foot 423 at least partially underneath intrinsic overhang 425, as pictured. Thus, for example, if a sudden gust of wind were to lift canopy tent 303 and its legs 307 upwards, substantially flat foot 423 is likely to catch on overhang 425, and remain anchored to towel or mat 301, in accordance with some embodiments of the present invention. Generally speaking, in some embodiments, complementarily shaped bottom 427, and foot-accepting trench device 317 generally, extend below the surface of recreation area 302, and are embedded within sand or ground particles 106.

However, rather than re-illustrate the example exterior pocket(s) and/or sheath(s), such as example pocket or sheath 321 set forth above, the enlarged view shown in FIG. 4 shows another embodiment of leg- and tent-anchoring technology that may be used in at least some embodiments of the invention. In some embodiments, in addition to, or as an alternative to pocket(s) or sheath(s), one or more exterior strap(s) 431 are included, stitched, bonded, connected or otherwise fastened to exterior surface 316 of sand guard 311. In some embodiments, exterior straps 431 are configured to temporarily bind and unbind legs 307 to an exterior surface of sand guard 311, such as outer side 316, when installed. For example, in some embodiments, exterior straps 431 are configured to temporarily bind and unbind legs 307 to an exterior surface of sand guard 311 with included Velcro connectors, such as example Velcro hook-lined strap surface 433 and example Velcro loop-lined strap-receiving surface 435. However, in some embodiments, exterior straps 431 are configured to temporarily bind and unbind legs 307 to an exterior surface of sand guard 311 with any other suitable form of reversible connector. A wide variety of such reversible connectors may be additionally or alternatively used to fasten exterior straps 431, which are known in the art, and will be readily apparent to those of ordinary skill in the art to which the present application pertains. For example, in some embodiments, snaps are so used. As another example, in some embodiments, eye-and-hook fasteners are so used. Regardless of what form of connector is used, a user may draw exterior strap(s) 431 over and about the perimeter of a tent support, such as one of legs 307, and fasten it to the outer side 316 on both lateral sides of the support. Exterior strap(s) 431 may be permanently bound on one of those sides (e.g., by example stitching 437) while variably-, reversibly-connected as discussed above, on the other side. Thus, when fastened, as shown by example upper strap 439, the straps may be drawn taught about the support, such as one of legs 307, holding it in place, and binding it to outer side 316 and larger format beach towel or mat 301. When unfastened, however, as shown by example lower strap 441, the support 307 is no longer bound by such an unfastened strap, and may be uninstalled from larger format beach towel or mat 301.

Figure 5:
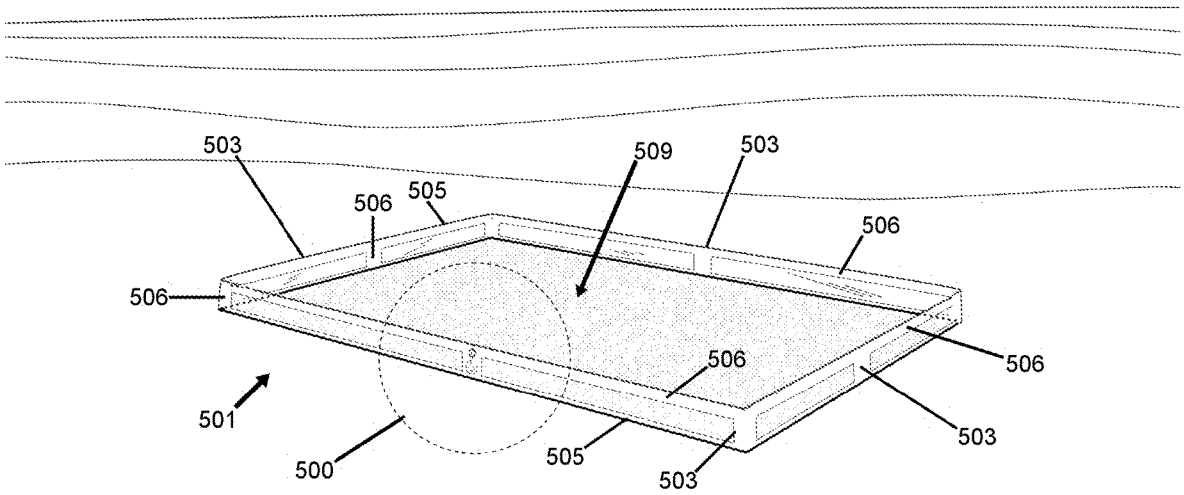
FIG. 5 is a perspective view of another example beach towel, adapted for use in a beach setting, in accordance with some embodiments of the present application.

FIG. 5 is a perspective view of another example beach towel 501, adapted for use in a beach setting, such as beach setting 103, in accordance with aspects of the present application. In addition to any and all other aspects set forth above for beach towels, mats and tarps in accordance with the present invention, beach towel 501 includes a sand guard in some embodiments—in this instance, example sand guard 503. However, in some embodiments, rather than utilize rigid, ground-planted stakes, such as ground-penetrating stakes 113 and sand guard stakes 117 discussed above, beach towel 501 instead erects sand guard 503 with a series of interconnected inflatable chambers 505 (a.k.a. an "inflatable skeleton"). In some embodiments, at least some of interconnected inflatable chambers 505 share a common internal lumen, or lumens, 506 such that, when one of inflatable chambers 505 is inflated with air or another gas, all of inflatable chambers 505 become inflated. Inflatable chambers 505 preferably comprise a flexible, airtight textile with limited elasticity. As a result, when filled with air or another gas via inflation, inflatable chambers 505, and sand guard 503 generally, create an at least semi-rigid structure suitable for blocking the ingress of sand grains or other ground particles. In some embodiments, inflatable chambers 505 so create a structure in the form of a straight vertical wall, mounted at, or at about, 90 degrees from the upper flat surface 509 of beach towel 501, and the remainder of beach towel 501 generally.

Figure 6:
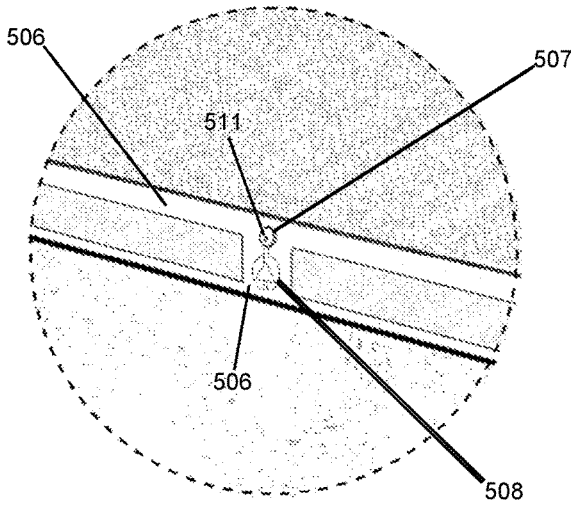
FIG. 6 is an enlargement for magnification purposes of a partial view of FIG. 5, showing details of example inflation and deflation devices within the structure of an example beach towel, in accordance with additional embodiments of the present application.

Details of substructures adapted for the inflation (and, in some embodiments, deflation) of interconnected inflatable chambers 505 are shown within partial view 500 of FIG. 5, which is enlarged for magnification purposes in FIG. 6.

To aid in inflating, and (in some embodiments, after use and during stowing procedures, deflating) interconnected inflatable chambers 505, an outward-facing valve 507 and/or pump 508, connected to common internal lumen(s) 506, is/are included in some embodiments, which permit a user to pump or otherwise push air or other gases into (or let air or other gases out of) interconnected inflatable chambers 505, and retain it/them there. In some embodiments, outward-facing valve 507 may be in any suitable form known in the art for permitting inlet of gases and for holding gases within inflatable chambers. In some embodiments, valve 507 may be a stem valve, with a user-sealable and/or releasable aperture or other closure 511. Likewise, in some embodiments, pump 508 may be any suitable type of air or gas pump known in the art for driving gas into (and, in some embodiments, out of) inflatable chambers through a valve, such as outward-facing valve 507. In some embodiments, pump 508 may be hand-operated. In some of those and some other embodiments, pump 508 may also be battery- and/or electrically-powered (e.g., with a button for switching on an air pump driven by an electric motor.)

Figure 7:
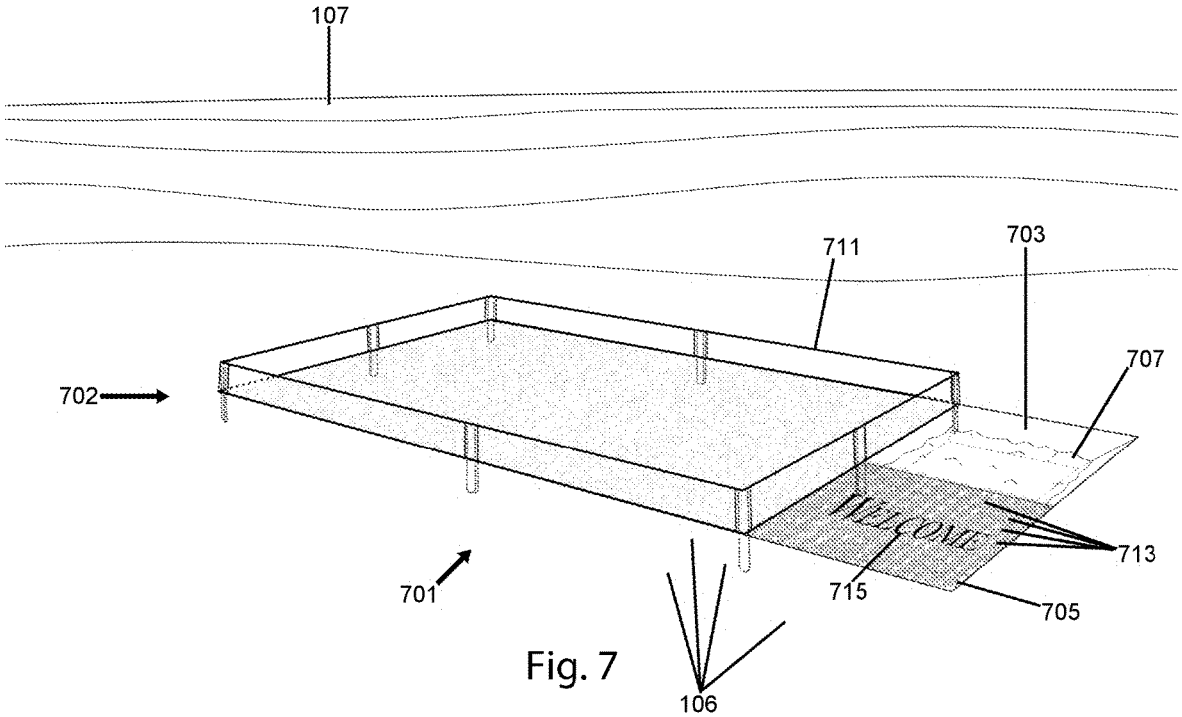
FIG. 7 is a perspective drawing of another example form of beach towel adapted for use in a beach setting, with a built-in wading pool and entry device in accordance with some embodiments of the present application.

FIG. 7 is a perspective drawing of another example form of beach towel 701 adapted for use in a beach setting, such as that previously shown as beach setting 103, with a built-in wading device 703 and entry structure 705 in accordance with some embodiments of the present application.

As with complementarily shaped bottom 427, and foot-accepting trench device 317, discussed above, in some embodiments, built-in wading device 703 extends below the surface of a personal recreation area (now shown as personal recreation area 702), and is embedded within sand or ground particles 106. Thus, when filled with water (e.g., by a child with a pale transferring water to it from the ocean 107), a shallow aquatic wading pool 707 can be created, in accordance with some embodiments. In some embodiments, wading device 703 comprises a suitable material for defining or creating an aquatic play area or wading pool 707 in the ground. For example, in some such embodiments, wading device 703 comprises a waterproof lining. As another example, in some embodiments, wading device 703 comprises structural materials. In some such embodiments, wading device 703 comprises metal. In some embodiments, wading device 703 comprises plastic. In some embodiments, wading device 703 comprises rubber. In some embodiments, the depth of wading pool 707 is below 6 inches. In some embodiments, the depth of wading pool 707 is below 1 foot. In some embodiments, the depth of wading pool 707 is below 3 feet. In some embodiments, the depth of wading pool 707 is any suitable depth and wading device 703 is any suitable shape to making accidental drowning unlikely. Wading device 703, in conjunction with a sand guard, such as sand guard 711, which may be of a nature similar to any of the sand guards discussed elsewhere in this application, also naturally encourages children to stay close by, and within personal recreation area 702, under the observation of adults within personal recreation area 702, and in greater safety generally.

Overall, according to some embodiments, beach towel 701, and some other embodiments of towels and mats set forth in the present application, create a defined personal recreation area, encouraging young children to stay within or close to the "home base" of the personal recreation area, such as personal recreation area 702.

In some embodiments, entry structure 705 includes surface-covering bristles, such as the examples shown as surface-covering bristles 713. In some embodiments, entry structure 705 includes other sand grain or loose particle gathering or removing sub-structures. In some embodiments, entry structure 705 also comprises an ornamental sign or decal 715. In some embodiments, any surface of beach towel 701, or any other towel or mat set forth in the present application, may be adorned with decals, prints or other decorative aspects, as well.

Figure 8:
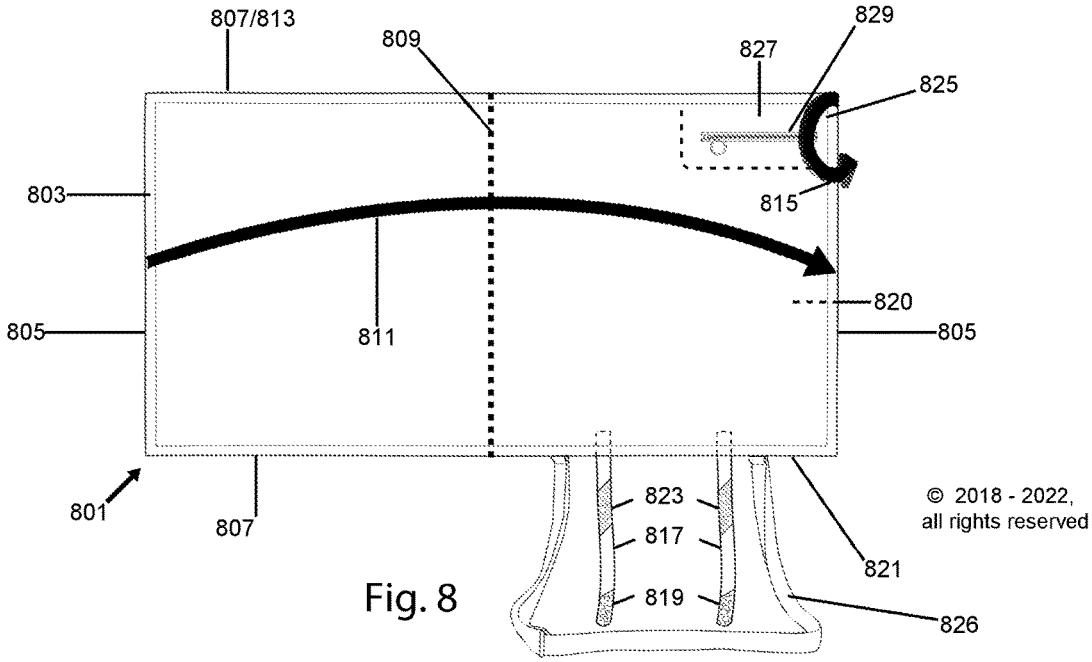
FIG. 8 is a top view of another example beach towel or mat configured for facilitated folding, rolling, fastening and toting methods in accordance with some embodiments of the present application.

FIG. 8 is a top view of another example beach towel 801 (which, as with any other towel set forth in the present application may be, alternatively, in various embodiments, a mat, tarp or other ground-covering device), configured for facilitated folding, rolling, fastening and toting in accordance with aspects of the present application. Although, in some embodiments of the present invention, a perimeter-lining rope and/or other raised lip, such as low-profile sand guard 803 may be included within towel or mat 801, to prevent some influx of sand or other loose particles, a larger, more substantial sand guard is not necessarily present in all embodiments of beach towel 801. Instead, beach towel 801 is preferably configured for folding, rolling, fastening and toting, with a lower profile, if any, raised sand guard such as example low-profile sand guard 803 (which rises out of the page, in the perspective of the figure.) As with other towels, mats and tarps set forth in the present application, beach towel 801 comprises a generally flat, flexible sheet of textile material, and may be generally rectangular in some embodiments, with two opposing width edges 805 shorter than other opposing length edges 807.

Figure 10:
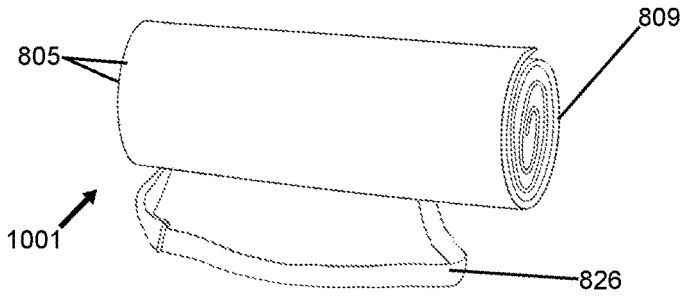
FIG. 10 is a perspective view of a rolled, tubular configuration of the example beach towel or mat, set forth above, in reference to FIGS. 8 and 9, in accordance with additional embodiments of the present application.

In one method of compressing and toting beach towel 801 in accordance with aspects of the present invention, beach towel 801 is first folded laterally, bringing opposing width edges 805 together, and creasing towel or mat 801 along a folding line 809, as shown by edge movement and folding motion arrow 811. At that point in time, the top-view profile of beach towel 801 will have been reduced by approximately one half. Following that step, a user may then lift the nearest edge to him or her—such as, upper edge 813 (which has been folded over onto itself) and roll the edge upward, over the top (the surface facing a viewer of the figure), as shown by rolling motion arrow 815. The user may continue that rolling motion until the entire beach towel 801 has been rolled into a tube configuration. Such an exemplary rolled, tube configuration is generally shown below, in reference to FIG. 10, as configuration 1001. To bind towel or mat 801 in such a rolled configuration, self-binding wraps 817 may be included, and may be attached to an outward-facing surface 820 and edge 821 of towel or mat 801, when it is rolled as set forth above. In some embodiments, self-binding wraps 817 may be lined with complementary Velcro or other fastener surfaces, such as exemplary Velcro hook regions 819 and complementary Velcro loop regions 823. Thus, when wrapped around the outer surface of rolled beach towel 801, wraps 817 may attach to themselves, via the fastener-lined surfaces, locking beach towel 801 in the rolled, tube configuration discussed in this application.

To ease toting, once rolled, a shoulder strap 826, also attached to the same outward-facing surface 820 and edge 821 of beach towel 801, may be included.

Figure 9:
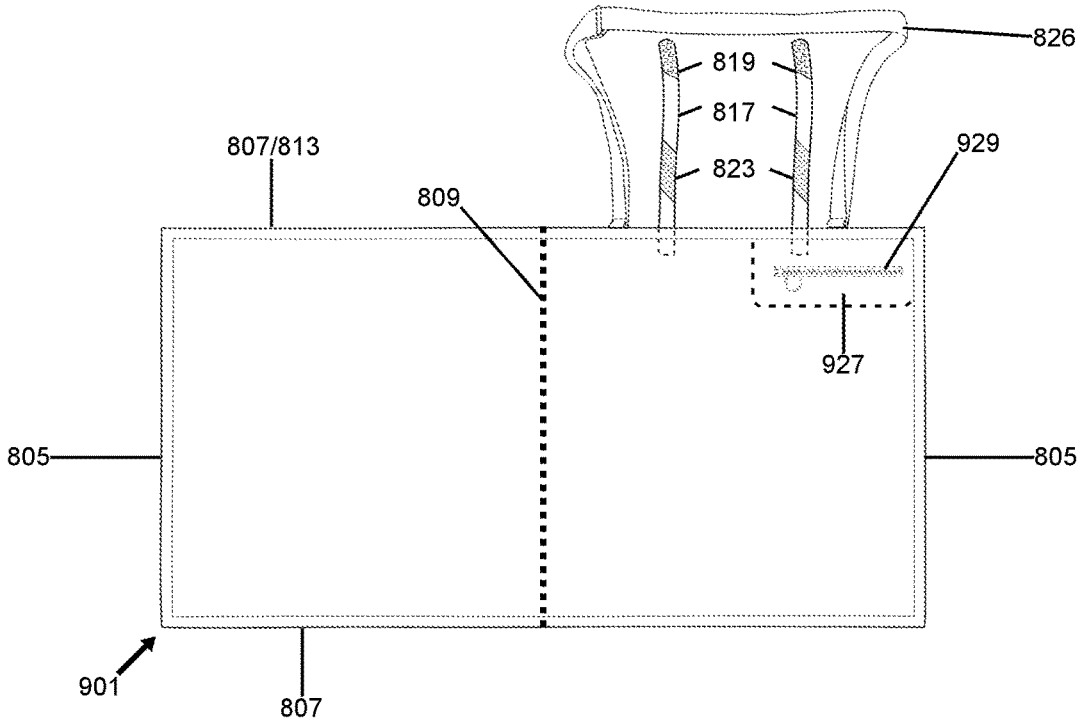
FIG. 9 is another top view of the example beach towel or mat configured for facilitated folding, rolling, fastening and toting, as set forth in FIG. 8, above, in accordance with additional embodiments of the present application.

Also, in some embodiments, an internal (or, in some embodiments, external) compartment 825, with a hidden volume 827 for stowing valuables or other items, may be included. In some embodiments, compartment 825 may be variably closed and sealed with a slide fastener, such as example zipper 829, as also shown in alternate configuration 901 as zipper 929 in FIG. 9. It should be noted that the exemplary towel or mat shown as 801 depicts an internal compartment 825 (with slide fastener 829 facing the interior of the tube structure when rolled as set forth above). However, in other embodiments, slide fastener 929 may instead open from the exterior (opposing flat side) of towel or mat 801/901.

Figure 11:
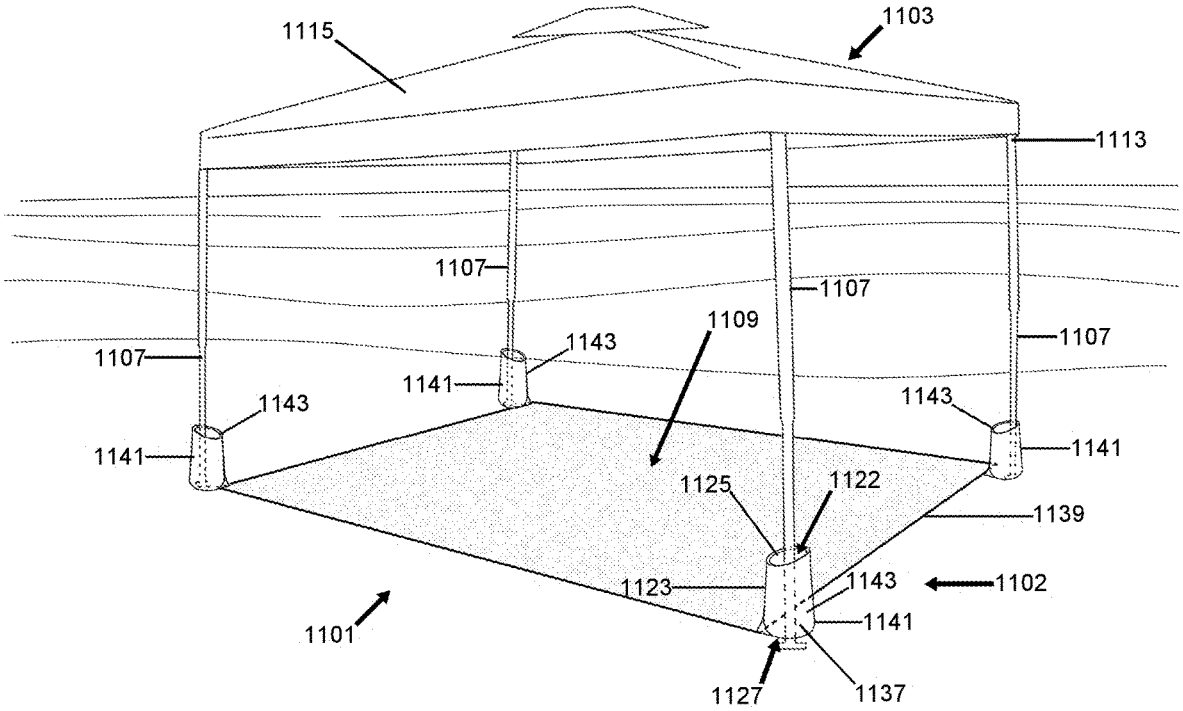
FIG. 11 is a perspective view of another example beach towel, adapted for use with a pop-up canopy tent, in accordance with some embodiments of the present application.

FIG. 11 is a perspective view of another example beach towel 1101, adapted for use with a pop-up canopy tent 1103, in accordance with some embodiments of the present application. As with any other beach towel, mat or tarp set forth in the present application, any aspects of beach towel 1101, discussed in this application, may instead be implemented relative to any other mat, tarp or other ground-covering flexible sheet. The example of a beach towel, as set forth in the present figure, is illustrative, not exhaustive, of the various possible embodiments of the present invention, as will be readily apparent to those of ordinary skill in the art. In addition to, or instead of, the beach towel materials and structures set forth in this application, materials more suitable for tarps and mats, used in different terrain, may be used, in some such embodiments of the invention.

As with other beach towels, mats and tarps discussed in the present application, beach towel 1101 is adapted for use in a beach setting, and is shown placed on a personal recreation area, now personal recreation area 1102, of a suitable size for a person or persons to engage in recreational activities. More specifically, as with some embodiments set forth above, in reference to FIG. 3, in some embodiments, beach towel 1101 comprises also an upper flat surface, now upper flat surface 1109, of larger format beach towel or mat, and may comprise any or all of the same or similar types of textiles and other materials and substructures as set forth above for beach towels, mats and tarps above. That larger format may, as also discussed above, allow users to comfortably lie, sit or engage in other recreational activities on a larger personal recreational area, such as personal recreation area 1102. In some embodiments, personal recreational area 1102 and upper flat surface 1109 may be at least twice as large as personal recreational area 102. In still other embodiments, personal recreational area 1102 and upper flat surface 1109 may be, or may approximately be, a 10-foot-by-10-foot area. In some embodiments, personal recreational area 1102 and upper flat surface 1109 may be, or may approximately be, any other area typically coinciding or nearly coinciding with popular pop-up canopy tents, as discussed elsewhere in this application.

Also as with embodiments set forth in reference to FIG. 3, in some embodiments, beach towel 1101 comprises at least one additional substructure, configured to accept and anchor the legs 1107 of example pop-up canopy tent 1103's frame 1113, which legs 1107, in turn, anchor and support example canopy 1115. In one embodiment set forth in reference to FIG. 11, a new form of support-accepting pocket 1137 is provided. Rather than being attached, fastened and/or bonded to a sand-guard, support-accepting pocket 1137 is attached, fastened and/or bonded directly on or about at least one edge 1139 of beach towel 1101, in some embodiments. However, it should be understood that, in some embodiments, support-accepting pocket 1137 may be attached to another surface or aspect of beach towel 1101. For example, in some such embodiments, beach towel 1101 is attached to a surface of a sand guard attached to a periphery or edge of beach towel 1101. However, in some embodiments, such as the embodiments pictured, a sand guard is omitted.

In any event, support-accepting pocket 1137 preferably comprises an open top 1122, and at least one wall(s) 1123, encompassing a passageway and leg-holding volume 1125. In some embodiments, support-accepting pocket 1137 comprises an open bottom 1127, allowing supports (such as legs 1107) or other materials to pass completely through them, and onto the ground or other intermediate structures, as discussed further herein (and pictured). In some embodiments, however, support-accepting pocket 1137 comprises an closed bottom, protecting a ground material from the otherwise exposed bottoms of legs 1107. Also as pictured, and as set forth for other support-accepting pockets in the present application, in some embodiments, a set of support accepting pockets in the same form as support-accepting pocket 1137 may provided. For example, in some such embodiments, a set such as the pictured set 1141 is provided, which includes four support-accepting pockets 1143, spaced at strategic positions to accept and join supports, such as legs 1107, with beach towel 1101, and, in so doing, draw beach towel 1101 tight against the ground and co-locate canopy tent 1103 and beach towel 1101, over the same personal recreation area 1102. In some such embodiments, pockets such as support-accepting pockets may be attached to, and provided at, each corner of beach towel 1101, to aid in accepting and conjoining beach towel 1101 with tent legs 1107.

It should be noted that, although support-accepting pocket 1137 and support-accepting pockets 1141 are pictured as loosely-fitting around legs 1107, in some other embodiments, such support-accepting pocket(s) fit legs 1107 more tightly, with less lateral play between the material(s) of each such support-accepting pocket(s) and each of the legs 1107. In some such embodiments, such support-accepting pocket(s) may be provided in a shape that conforms with, but is slightly larger than, the shape of legs 1107. For example, in some embodiments, less than one inch of space between the outside of legs 1107 and the inside of such support-accepting pocket(s) is provided. In some embodiments, less than one-half inch of space between the outside of legs 1107 and the inside of such support-accepting pocket(s) is provided. In yet other embodiments, less than one-quarter inch of space between the outside of legs 1107 and the inside of such support-accepting pocket(s) is provided. In some embodiments, each of support-accepting pockets 1143 is shorter than that pictured in the figure. For example, in some such embodiments, each of support-accepting pockets 1143 is less than 5 inches in height. As another example, in some such embodiments, each of support-accepting pockets 1143 is less than 4 inches in height. As another example, in some such embodiments, each of support-accepting pockets 1143 is less than 3 inches in height. As another example, in some such embodiments, each of support-accepting pockets 1143 is less than 2 inches in height. As another example, in some such embodiments, each of support-accepting pockets 1143 is less than 1 inch in height. As another example, in some such embodiments, each of support-accepting pockets 1143 is less than one-half inch in height. In some embodiments, each of support-accepting pockets 1143 includes a rigid material. In some such embodiments, such a rigid material does not comprise a textile. In some such embodiments, such a rigid material comprises a plastic. In some such embodiments, such a rigid material comprises a metal or metal alloy. In some embodiments, each of support-accepting pockets 1143 is formed from material of the beach towel 1101 itself. For example, in some such embodiments, a rectangular beach towel includes support-accepting pockets at each corner, and those support-accepting pockets are formed by folding over and stitching material of each corner to material of part of the remainder of beach towel 1101 abutting the material of each corner, while leaving an opening between the material of each corner and the material of part of the remainder of beach towel 1101 abutting the material of each corner. Thus, in some method embodiments of the present invention, a pocket is formed by stitching corners of a beach towel, without adding additional materials (other than stitching). In some embodiments, however, additional material(s) may be added. For example, in some embodiments, a square piece of material may be stitched at the edges of each corner of the beach towel and the edges of the additional material, while leaving an opening for accepting legs 1107. As another example, in some embodiments, a triangular piece of material, may be stitched at the edges of each corner of the beach towel and the edges of the additional material, while leaving an opening for accepting legs 1107.

It should be noted that any aspect(s) of the invention set forth in this application may be practiced in combination with any other aspect(s). The recitation of particular embodiments, and combinations, as set forth above, are exemplary only, and do not limit the scope of the invention. For example, in some embodiments, each corner of any towel, mat and/or tarp, or each other towel-, mat- and/or tarp-anchoring or support-accepting aspect of any towel, mat and/or tarp, may be present in combination with any or all other types of corners or towel-, mat- and/or tarp-anchoring or support-accepting aspects set forth in this application. As just one exemplary combination, which may be preferred, each corner of any of the towel, mat and/or tarps set forth above, may include an interior pocket(s) fastened to at least one interior surface of the sand guard, such as that described as 114, along with stake-accepting pockets, such as those described as stake-accepting pockets 119, with ground-penetrating stakes, such as ground-penetrating stakes 113 and sand guard stakes 117, installed within them, at each such corner, and an exterior pocket(s) or sheath(s), such as example pocket or sheath 321, along with one or more exterior support-wrapping straps 431, in one particular embodiment.

Figure 12:
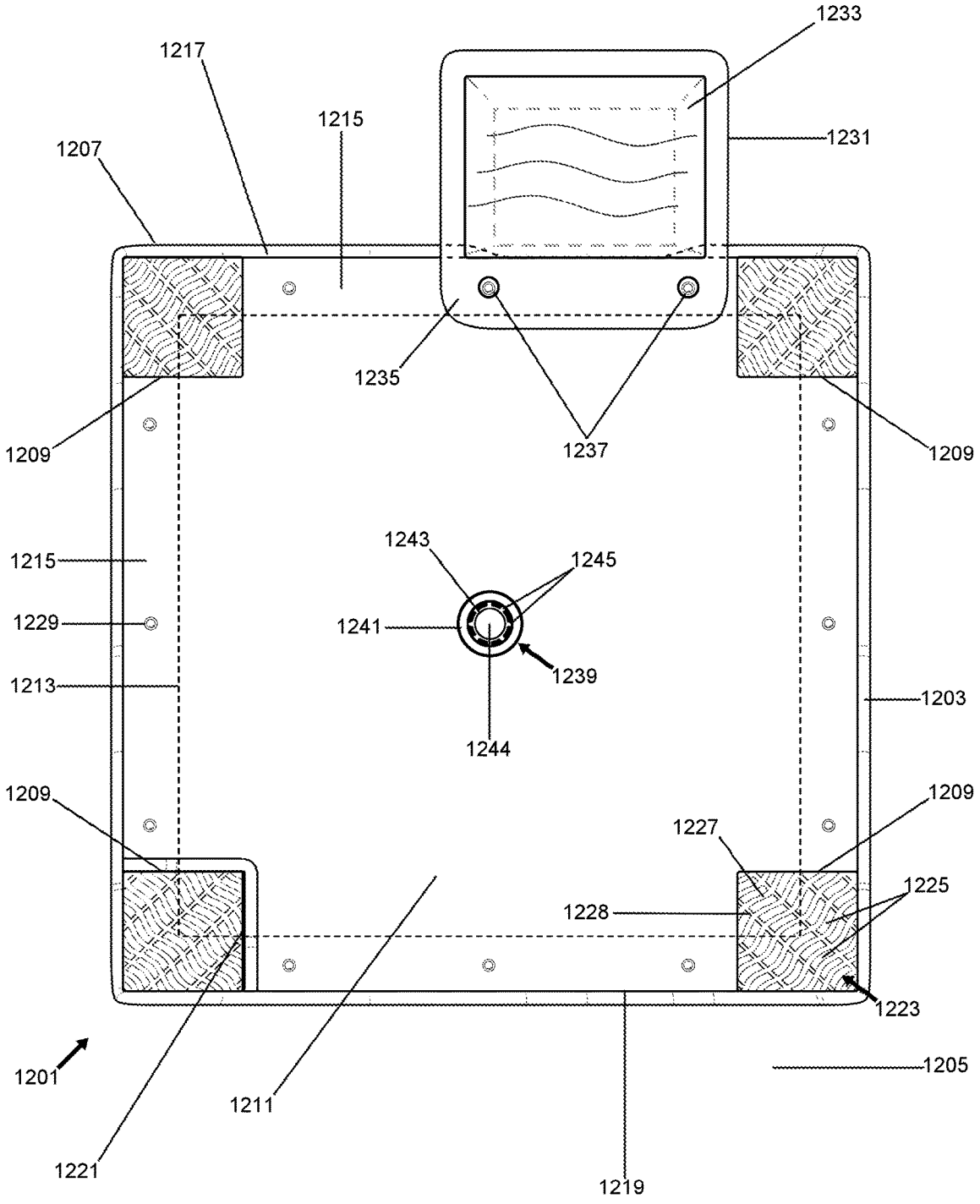
FIG. 12 is a top view of an example beach towel, mat or other ground-covering sheet including a new form of attached or integrated sand guard, and having flat, reinforced areas configured to receive structural support pieces for a tent or other structure placed on the ground-covering sheet, in accordance with some embodiments of the present invention.

FIG. 12 is a top view of an example beach towel, mat, tarp or other ground-covering sheet 1201 including a new form of attached or integrated sand guard 1203, and having flat, reinforced areas configured to receive structural support pieces for a tent or other structure placed on the ground-covering sheet, in accordance with some embodiments of the present invention. In some embodiments, such a tent may be a canopy tent (not pictured), which may be similar in nature to canopy tent 1103, discussed above, which may have extendable/collapsible telescoping tent support legs, which may be similar in nature to other tent legs set forth above, such as legs 307 and 1107, providing support for the remainder of the canopy tent (e.g., including feet with a flattened, widened profile, larger in comparison to the diameter of the remainder of the tent support legs). In some embodiments, the feet include central ports at their base, for receiving ground-penetrating stakes, ties or other support structures. In some embodiments, such feet may include one such port each. In some embodiments however, such feet may each include a plurality of such ports. In some embodiments, such feet may include ground-penetrating projections (e.g., integrated stakes), which may be in addition to ground-penetrating stakes such as those discussed above, and more conventional tent stakes known in the art, which may be used to pierce such ports, and anchor such feet (and the entire canopy tent attached to them) to the ground.

In either event, new, specialized aspects of ground-covering sheet 1201 aid in anchoring ground-covering sheet 1201, and such a canopy tent placed over it, to the ground 1205 (which may be ground including a personal recreation area 1207, over which ground-covering sheet 1201 has been placed). In some embodiments, ground-covering sheet 1201 includes reinforced, specialized sections, such as example reinforced corner support sections 1209 (which reinforced, specialized sections include a stronger, more robust, larger or additional structural component, other than the material present in parts of the sheet other than the reinforced, specialized sections) configured to receive and hold any of the legs, ground stakes and/or other parts related to structures to be mounted in, on or about such ground-covering sheets set forth in this application, or know in the art.

As with other beach towels, mats and tarps discussed in the present application, ground-covering sheet 1201, when unfolded and laying flat as pictured, is of a suitable size for a person or persons to engage in outdoor (e.g., recreational) activities on its upper flat surface 1211. More specifically, as discussed above in reference to FIG. 11, in some embodiments, upper flat surface 1209 may be a larger format mat, tarp or other ground-covering sheet—e.g., suitable for placement over an area coinciding with, or slightly larger or smaller than, the footprint of, or area covered by, a conventional canopy tent (e.g., a 10-foot-by-10-foot area, such as the example 10-foot-by-10-foot central area 1213). In some embodiments, however, ground-covering sheet 1201 and upper flat surface 1211 has a larger area than most such larger format mats, tarps or other ground-covering sheets. For example, in various embodiments, ground-covering sheet 1201 and upper flat surface 1211 have a length or width approximately 3 inches, 4 inches, 6 inches, 9 inches, 10 inches, 12 inches, 14 inches, 16 inches, 18 inches, 20 inches, 22 inches or 2 feet wider (the latter example being pictured) and longer than most such larger format mats, tarps or other ground-covering sheets (e.g., ordinarily being 10 feet by 10 feet in area), and therefore including an additional outer area 1215, created by such those wider, longer dimensions. In some embodiments, additional outer area 1215 may include any of the reinforced corner sections set forth in this application, or at least the majority of such reinforced corner sections, such as example reinforced corner support sections 1209.

In some embodiments, as pictured, a sand, dirt, fluid and/or debris guard (a.k.a., a "sand guard"), such as example sand guard 1217, is included in ground-covering sheet 1201. In some embodiments, sand guard 1217 may be a lower profile sand guard than some sand guards set forth in this application. For example, in some embodiments, sand guard 1217 is approximately 1 inch in height, off the ground. In some embodiments, sand guard 1217 is rounded in shape, or partially rounded in shape (on an upward-facing surface). In some such embodiments, sand guard 1217 is provided on or about (e.g., attached to and/or integrated with) an outer edge or periphery 1219 of ground-covering sheet 1201. In some embodiments, however, at least part of such a sand guard may be provided at or about at least part of the interior edge of such reinforced corner sections, as shown as example interior edge 1221 of one or more of the reinforced corner support sections 1209 (shown in the pictured example around the lower, left-hand side reinforced corner support section. But, in a preferred embodiment, such a sand guard 1217 is at least generally provided on or about the edge of outer edge of additional outer area 1215, except in the areas of such reinforced corner sections, as pictured. However, in some embodiments, such as the embodiments pictured, a sand guard is omitted.

In some such embodiments, such reinforced, specialized sections include a matrix of expandable receiving brackets 1223, through which the support legs, ground stakes and/or other parts can penetrate, and reach and obtain direct support from the ground below such ground-covering sheets. In some embodiments, such receiving brackets 1223 may be formed from a flexible, strong material. For example, in some embodiments, receiving brackets 1223 may be formed from any suitable plastic known in the art, such as nylon or polyethylene. As another example, in some embodiments, receiving brackets 1223 may be formed from a rubber or rubberized material. In some embodiments, receiving brackets 1223 may be formed from a fabric. In some embodiments, receiving brackets 1223 may be formed from a mesh of materials, including ports, such as example ports 1225, formed by crossing and/or fused members, such as the examples shown as curved members 1227 and cross-members 1228, each of which may be attached or integral with one another, and/or the remainder of ground-covering sheet 1201, in some embodiments. In some such embodiments, as a stake, tent leg, or other structural support is driven downward (into the page, in the perspective of the figure), and into one or more of ports 1225, such fused members are preferably flexible enough to spread apart around such a stake or other structural support, and grip the structural support. In some embodiments, to enhance such gripping, each of such members include gripping ridges (at interior, lateral sides of such members, facing the structural support). In some embodiments, at least some of curved members 1227 and/or at least some of cross members 1228, are include multiple curves, increasing the likelihood that a pointed support driven into one of the reinforced corner support sections 1209 will enter one of the ports, while also increasing support for flat structural supports placed on top of reinforced corner support sections 1209.

However, in some embodiments, rather than the example matrix of expandable receiving brackets discussed above, such reinforced, specialized sections include a different form of stronger, more robust, thicker or otherwise more supportive material that can be penetrated by a ground-penetrating stakes. For example, in some embodiments, such reinforced, specialized sections include a porous textile (including pores which can be entered and expanded by a ground-penetrating stake driven through it). In some embodiments, such a different form of material may include a woven material.

In various embodiments, any or all of the same or similar types of textiles and other materials and substructures as set forth above for beach towels, mats and tarps above, may be included within ground-covering sheet 1201.

In some embodiments, ground-covering sheet 1201 may include reversible fasteners, or parts thereof, such as example snap fasteners 1229, on or about outer edge or periphery 1219. In some embodiments, such reversible fasteners aid in conjoining ground-covering sheet 1201 with additional components, also bearing fasteners, or fastener parts, in a matching pattern about their edge, that reversibly conjoin with such reversible fasteners. In this way, a user of conjoining ground-covering sheet 1201 may attach and remove several other optional components (a.k.a., modular add-on components), extending the footprint and functionality of ground-covering sheet 1201 to match particular activities and use cases.

For example, in some embodiments such a modular add-on component is a foot bath 1231, including fluid-holding basin 1233, and an interfacing flange 1235, including snap fasteners 1237. In some embodiments, snap fasteners 1237 are complementary to, match, and/or fit together with example snap fasteners 1229, of sheet 1201.

In some embodiments, another port, outside of reinforced corner support sections 1209, may be provided, to anchor, support, and allow objects and fluids to pass through ground-covering sheet 1201, in some embodiments. For example, in some embodiments, an interior port, such as example umbrella-supporting port 1239, may be provided. In some embodiments, such a supporting port may include an outer bracket 1241, reinforcing the supporting port and any structure inserted into it. In some embodiments, such a supporting port may also include a seal 1243 (e.g., made of silicone, rubber or another sealing material) with a narrower diameter than the outer bracket 1241, defining a central hole 1244, in ground-covering sheet 1201. However, in some embodiments, such a supporting port may also include drainage and flexibility-enhancing cut-outs, such as those shown as example vents 1245.

As with any other beach towel, mat or tarp set forth in the present application, any aspects of ground-covering sheet 1201, discussed in this application, may instead be implemented relative to any other mat, tarp or other ground-covering flexible sheet set forth in this application. The example embodiments pictured for ground-covering sheet 1201 are merely exemplary of the virtually innumerable embodiments that may be implemented, and falling within the scope of the present application. Such alternative embodiments, falling within the scope of the application, will be readily apparent to those of ordinary skill in the art.

What is claimed is:

1. A ground-covering sheet comprising:

a flat, upper surface;

a sand guard comprising a vertically-oriented outer periphery of said flat, upper surface, wherein said flat, upper surface is configured for a user to lay, and wherein said sand guard extends above said flat, upper surface and comprises a top edge and a lower area, and wherein said top edge is not fully supported by any auxiliary support member;

at least one reinforced, specialized section(s), on or about a corner of said flat, upper surface, wherein said at least one reinforced, specialized section(s) comprises a stronger, more robust, larger and/or additional structural component, other than the material present in parts of the ground-covering sheet other than the at least one reinforced, specialized section(s);

wherein said at least one reinforced, specialized section(s) comprise at least one port or pore; and wherein said at least one port or pore comprises at least one downward-facing opening, coplanar, or substantially coplanar, with said flat, upper surface, at a first end of said at least one port or pore.

2. The ground-covering sheet of claim 1, wherein said flat, upper surface comprises a material suitable for absorbing and/or wicking away moisture from a human body.

3. The ground-covering sheet of claim 2, wherein said flat, upper surface comprises cotton.

4. The ground-covering sheet of claim 2, wherein said flat, upper surface comprises polyester.

5. The ground-covering sheet of claim 2, wherein said flat, upper surface comprises at least one form of nap.

6. The ground-covering sheet of claim 2, wherein said flat, upper surface comprises terry cloth.

7. The ground-covering sheet of claim 1, wherein said sand guard is at least partially rounded, at least on an exposed area of said sand guard.

8. The ground-covering sheet of claim 1, wherein said sand guard extends less than two inches above said flat, upper surface.

9. The ground-covering sheet of claim 1, wherein said sand guard at least partially lines an interior edge of said at least one reinforced, specialized section(s).

10. The ground-covering sheet of claim 1, wherein said sand guard at least partially lines an outer edge and/or periphery of said ground-covering sheet.

11. The ground-covering sheet of claim 9, wherein said sand guard at least partially lines an outer edge and/or periphery of said ground-covering sheet, which outer edge and/or periphery of said ground-covering sheet is different from said interior edge of said at least one reinforced, specialized section(s).

12. The ground-covering sheet of claim 1, wherein said ground-covering sheet comprises reversible fastener(s) configured to reversibly attach an edge of said ground-covering sheet to another device, extending the functionality of said ground-covering sheet.

13. The ground-covering sheet of claim 12, comprising said another device, extending the functionality of said ground-covering sheet.

14. The ground-covering sheet of claim 13, wherein said another device is a water basin, configured to fill a hole in a ground surrounding said ground-covering sheet when reversibly attached to said reversible fastener(s).

15. The ground-covering sheet of claim 1, wherein said ground-covering sheet comprises a central or other interior device-supporting port, larger in size than said at least one port or pore, and wherein said central or other interior device-supporting port is not located within said at least one reinforced, specialized section(s).

16. The ground-covering sheet of claim 1, wherein said ground-covering sheet comprises a bottom, comprising a water-proof or water-resistant material.

17. The ground-covering sheet of claim 1, wherein said at least one port or pore comprises a plurality of ports and/or pores.

18. The ground-covering sheet of claim 17, wherein said at least one reinforced, specialized section(s) each include at least one port and/or pore.

19. The ground-covering sheet of claim 17, wherein said at least one reinforced, specialized section(s) each include a plurality of ports and/or pores.

20. A method for installing a ground-covering sheet onto a recreational area, comprising the following step:

providing a ground-covering sheet comprising:

a flat, upper surface;

a sand guard comprising a vertically-oriented outer periphery of said flat, upper surface, configured for a user to lay, and wherein said sand guard extends above said flat, upper surface and comprises a top edge and a lower area, and wherein said top edge is not fully supported by any auxiliary support member;

at least one reinforced, specialized section(s), on or about a corner of said flat, upper surface, wherein said at least one reinforced, specialized section(s) comprises a stronger, more robust, larger and/or additional structural component, other than the material present in parts of the ground-covering sheet other than the at least one reinforced, specialized section(s);

wherein said at least one reinforced, specialized section(s) comprise at least one port or pore;

wherein said at least one port or pore comprises at least one downward-facing opening, coplanar, or substantially coplanar, with said flat, upper surface, at a first end of said at least one port or pore.

* * * * *